US005913322A

United States Patent [19]

Gallant et al.

[11] Patent Number: 5,913,322

[45] Date of Patent: Jun. 22, 1999

[54] TENT WITH PLURAL INFLATABLE MATTRESSES

[76] Inventors: John Patrick Gallant, 81 Charlton Ave. East Apt. 902, Hamilton, Ontario, Canada, L8N 1Y7; Kevin S. Geoghegan, 553 Tate Ave., Hamilton, Ontario, Canada, L8N 6L1

[21] Appl. No.: 08/988,633

[22] Filed: Dec. 11, 1997

[51] Int. Cl.[6] ..... E04H 15/36

[52] U.S. Cl. ..... 135/137; 135/124; 135/135; 5/710

[58] Field of Search ..... 135/98, 99, 135, 135/133, 137, 147, 151, 96; 5/710, 711, 713; 52/2.11, 2.22

[56] References Cited

U.S. PATENT DOCUMENTS

| | | | |
|---|---|---|---|
| 2,741,780 | 4/1956 | Kimbrig . | |
| 4,590,956 | 5/1986 | Griesenback . | |
| 4,750,509 | 6/1988 | Kim | 135/98 X |
| 4,766,918 | 8/1988 | Odekirk | 135/96 |
| 4,876,829 | 10/1989 | Mattick . | |
| 5,090,076 | 2/1992 | Guldager . | |
| 5,487,400 | 1/1996 | Dawkins . | |
| 5,490,295 | 2/1996 | Boyd . | |
| 5,566,409 | 10/1996 | Klearman . | |
| 5,655,239 | 8/1997 | Caparon et al. . | |
| 5,669,182 | 9/1997 | Griffis | 52/2.18 |
| 5,680,662 | 10/1997 | Purdy et al. . | |

*Primary Examiner*—Lanna Mai

[57] ABSTRACT

A new tent with plural inflatable mattresses for providing ideal sleeping conditions for more than one camper. The inventive device includes a base portion. A tent portion is secured to and extends upwardly from an outer periphery of the base portion. A plurality of mattresses are secured to the base portion in a side by side orientation. Each air mattress is defined by an inflatable hollow interior. The hollow interior has a plurality of support pockets extending between upper and lower surfaces of the air mattress. Each air mattress has an air inlet valve and an air outlet valve.

1 Claim, 2 Drawing Sheets

TENT WITH PLURAL INFLATABLE MATTRESSES

BACKGROUND OF THE INVENTION

1. Field of the Invention

The present invention relates to inflatable tents and more particularly pertains to a new tent with plural inflatable mattresses for providing ideal sleeping conditions for more than one camper.

2. Description of the Prior Art

The use of inflatable tents is known in the prior art. More specifically, inflatable tents heretofore devised and utilized are known to consist basically of familiar, expected and obvious structural configurations, notwithstanding the myriad of designs encompassed by the crowded prior art which have been developed for the fulfillment of countless objectives and requirements.

Known prior art inflatable tents include U.S. Pat. No. 4,928,442 to Koretch et al.; U.S. Pat. No. 4,835,800 to Johnson; U.S. Pat. No. Des. 361,364 to Winters; U.S. Pat. No. 4,531,330 to Phillips; U.S. Pat. No. 4,335,545 to Couch; and U.S. Pat. No. 4,607,655 to Wagner et al.

While these devices fulfill their respective, particular objectives and requirements, the aforementioned patents do not disclose a new tent with plural inflatable mattresses. The inventive device includes a base portion. A tent portion is secured to and extends upwardly from an outer periphery of the base portion. A plurality of mattresses are secured to the base portion in a side by side orientation. Each air mattress is defined by an inflatable hollow interior. The hollow interior has a plurality of support pockets extending between upper and lower surfaces of the air mattress. Each air mattress has an air inlet valve and an air outlet valve.

In these respects, the tent with plural inflatable mattresses according to the present invention substantially departs from the conventional concepts and designs of the prior art, and in so doing provides an apparatus primarily developed for the purpose of providing ideal sleeping conditions for more than one camper.

SUMMARY OF THE INVENTION

In view of the foregoing disadvantages inherent in the known types of inflatable tents now present in the prior art, the present invention provides a new tent with plural inflatable mattresses construction wherein the same can be utilized for providing ideal sleeping conditions for more than one camper.

The general purpose of the present invention, which will be described subsequently in greater detail, is to provide a new tent with plural inflatable mattresses apparatus and method which has many of the advantages of the inflatable tents mentioned heretofore and many novel features that result in a new tent with plural inflatable mattresses which is not anticipated, rendered obvious, suggested, or even implied by any of the prior art inflatable tents, either alone or in any combination thereof.

To attain this, the present invention generally comprises a base portion having a generally rectangular configuration. The base portion has a planar top surface and a planar bottom surface with a defined thickness disposed therebetween. A tent portion is secured to and extends upwardly from an outer periphery of the base portion. The tent portion has an openable entry therein and a plurality of loops extending outwardly therefrom. The loops are dimensioned for receiving supporting poles therein to maintain the tent portion in an erect orientation. The supporting poles have free lower ends for penetrating a recipient surface. A first air mattress and a second mattress are secured to the planar upper surface of the base portion in a side by side orientation. Each air mattress is defined by an inflatable hollow interior. The hollow interior has a plurality of support pockets extending between upper and lower surfaces of the air mattress. Each air mattress has an air inlet valve and an air outlet valve.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new tent with plural inflatable mattresses apparatus and method which has many of the advantages of the inflatable tents mentioned heretofore and many novel features that result in a new tent with plural inflatable mattresses which is not anticipated, rendered obvious, suggested, or even implied by any of the prior art inflatable tents, either alone or in any combination thereof.

It is another object of the present invention to provide a new tent with plural inflatable mattresses which may be easily and efficiently manufactured and marketed.

It is a further object of the present invention to provide a new tent with plural inflatable mattresses which is of a durable and reliable construction.

An even further object of the present invention is to provide a new tent with plural inflatable mattresses which is susceptible of a low cost of manufacture with regard to both materials and labor, and which accordingly is then susceptible of low prices of sale to the consuming public, thereby making such tent with plural inflatable mattresses economically available to the buying public.

Still yet another object of the present invention is to provide a new tent with plural inflatable mattresses which provides in the apparatuses and methods of the prior art some of the advantages thereof, while simultaneously overcoming some of the disadvantages normally associated therewith.

Still another object of the present invention is to provide a new tent with plural inflatable mattresses for providing ideal sleeping conditions for more than one camper.

Yet another object of the present invention is to provide a new tent with plural inflatable mattresses which includes a base portion. A tent portion is secured to and extends upwardly from an outer periphery of the base portion. A plurality of mattresses are secured to the base portion in a side by side orientation. Each air mattress is defined by an inflatable hollow interior. The hollow interior has a plurality of support pockets extending between upper and lower surfaces of the air mattress. Each air mattress has an air inlet valve and an air outlet valve.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
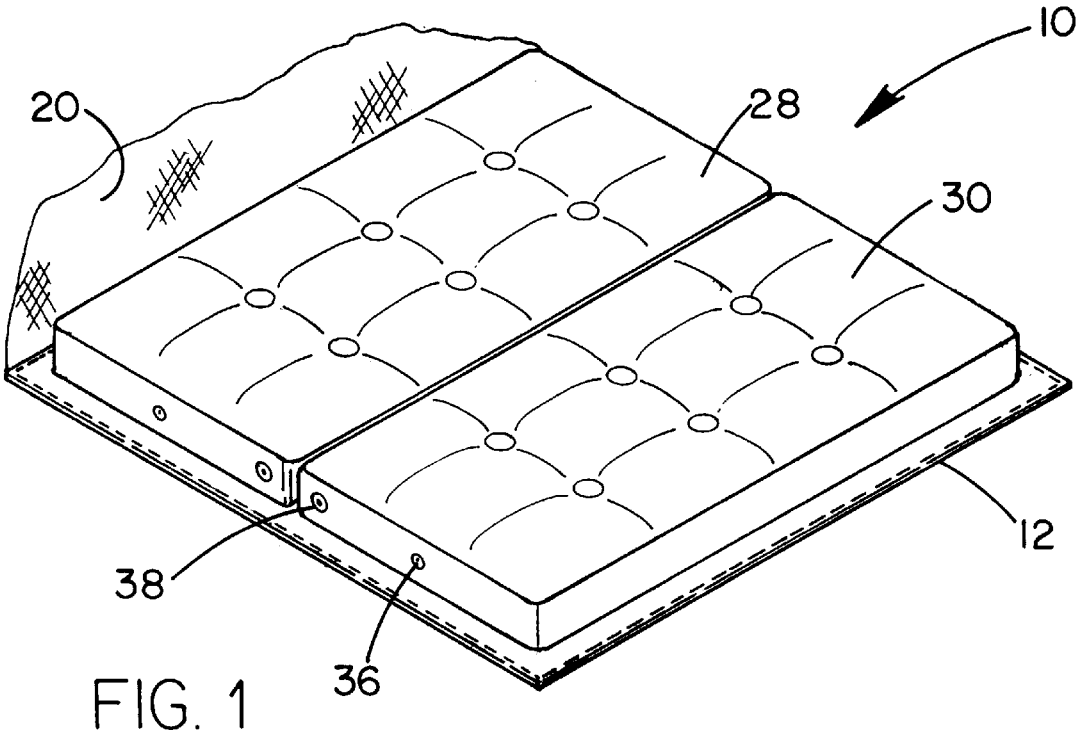
FIG. 1 is a perspective view of separate mattresses of a new tent with plural inflatable mattresses according to the present invention.
Figure 2:
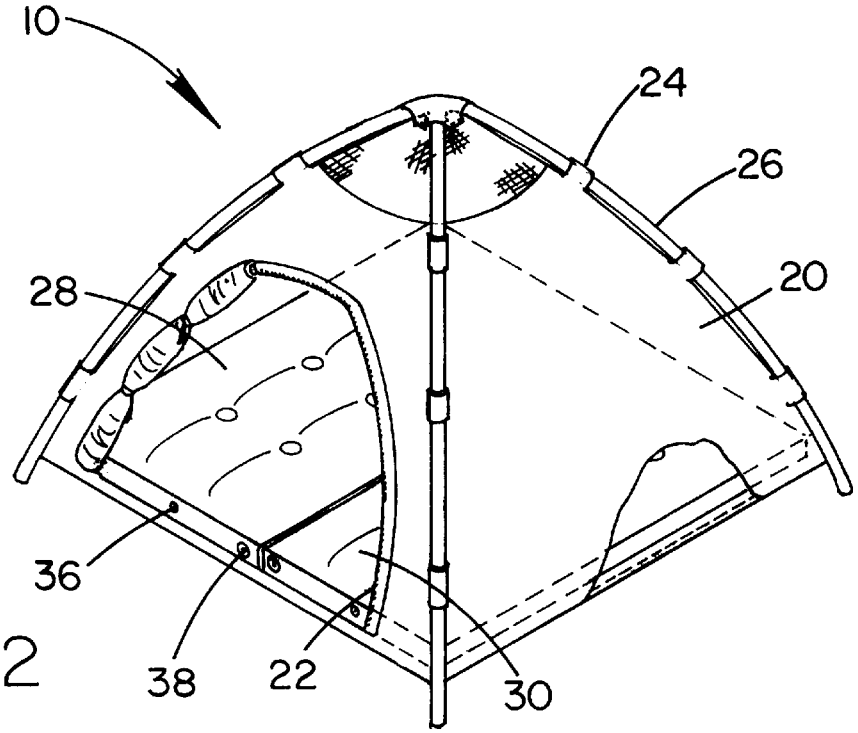
FIG. 2 is a perspective view of the present invention.
Figure 3:
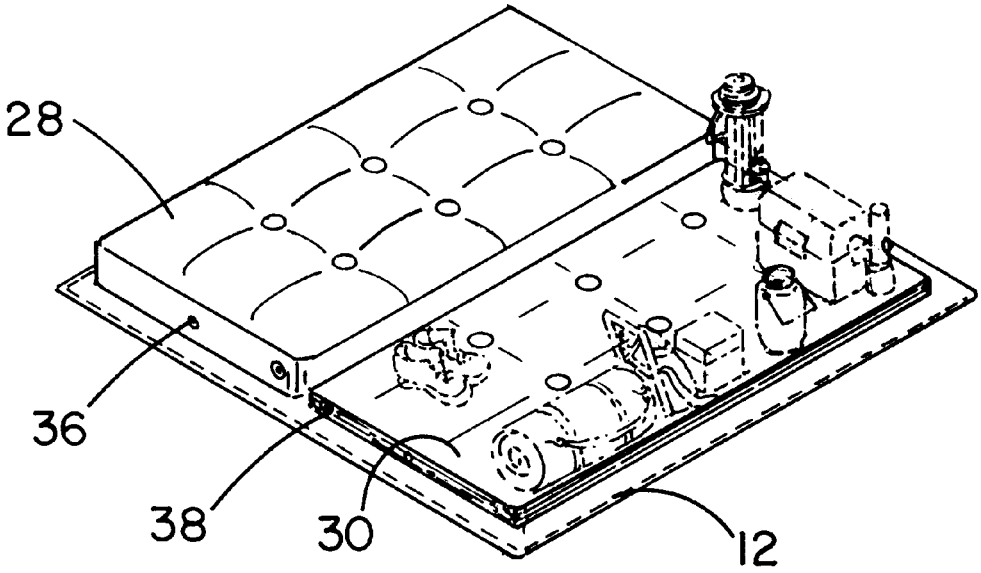
FIG. 3 is a perspective view of the separate mattresses of the present invention with one of the mattresses shown in a deflated orientation.
Figure 4:
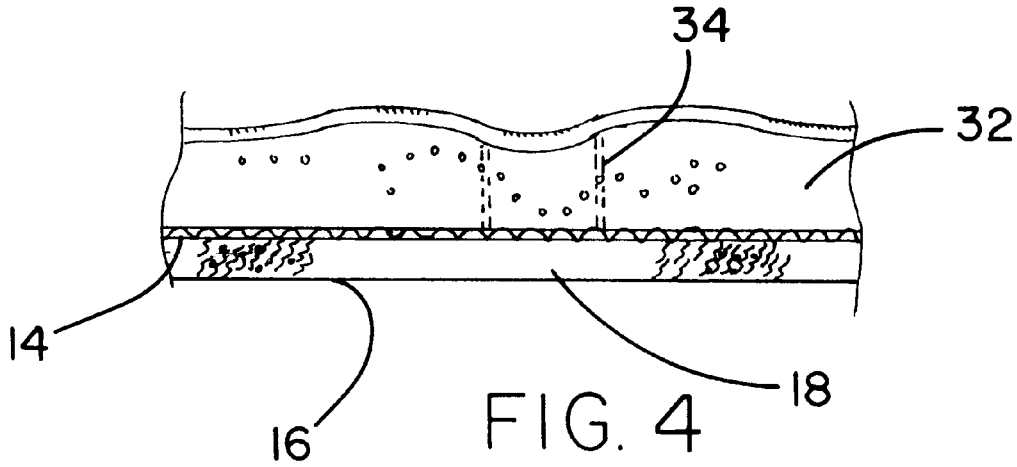
FIG. 4 is a cross-sectional view of one of the mattresses of the present invention.

With reference now to the drawings, and in particular to FIGS. 1 through 4 thereof, a new tent with plural inflatable mattresses embodying the principles and concepts of the present invention and generally designated by the reference numeral 10 will be described.

As best illustrated in FIGS. 1 through 4, the tent with plural inflatable mattresses 10 comprises a base portion 12 having a generally rectangular configuration. The base portion 12 has a planar top surface 14 and a planar bottom surface 16 with a defined thickness 18 disposed therebetween. The base portion 12 serves to elevate the device 10 above the recipient surface.

A tent portion 20 is secured to and extends upwardly from an outer periphery of the base portion 12. The tent portion 20 has an openable entry 22 therein and a plurality of loops 24 extending outwardly therefrom. The loops 24 are dimensioned for receiving supporting poles 26 therein to maintain the tent portion 20 in an erect orientation. The supporting poles 26 have free lower ends 28 for penetrating a recipient surface. The figures illustrate the tent portion 20 in a dome-like configuration. However, other shapes could also be incorporated into the device 10.

A first air mattress 28 and a second mattress 30 are secured to the planar upper surface 14 of the base portion 12 in a side by side orientation. Each air mattress 28,30 is defined by an inflatable hollow interior 32. The hollow interior 32 has a plurality of support pockets 34 extending between upper and lower surfaces of the air mattress 28,30. Each air mattress 28,30 has an air inlet valve 36 and an air outlet valve 38. The device 10 could incorporate any number of air mattresses to accommodate a greater number of users.

In use, the present invention allows each individual to adjust the inflation of their respective mattress to meet their desired comfort level. Each of the air mattresses 28,30 could be inflated by attaching a pump to the inlet valve 36. The outlet valve 38 could be used to reduce the amount of air within the air mattress 28,30 or for total deflation. Once the mattresses 28,30 are totally deflated, they can be rolled over one another for storage or transportation.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A tent with plural inflatable mattresses for providing ideal sleeping conditions for more than one camper comprising, in combination:

a base portion having a generally rectangular configuration, the base portion having a planar top surface and a planar bottom surface with a defined thickness disposed therebetween;

a tent portion secured to and extending upwardly from an outer periphery of the base portion, the tent portion having an openable entry therein and a plurality of loops extending outwardly therefrom, the loops dimensioned for receiving supporting poles therein to maintain the tent portion in an erect orientation, the supporting poles having free lower ends for penetrating a recipient surface; and a first air mattress and a second mattress of a similar shape and a similar size that when combined is approximately equal to that of the base portion, the mattresses being secured to the planar upper surface of the base portion in a side by side orientation, each air mattress being defined by a rectangular top face, a rectangular bottom face and a thin periphery formed of a pair of elongated side faces and a pair of short end faces with a first one of the end faces of each mattress being positioned adjacent to and in parallel with the outer periphery of the base portion below the entry of the tent portion, the hollow interior having a plurality of support pockets extending between upper and lower surfaces of the air mattress, each air mattress having an air inlet valve and an air outlet valve positioned on the first end face thereof wherein at least one of the inlet valve and the air outlet valve is positioned adjacent an inner one of the elongated side faces of the air mattress for being accessible via the entry of the tent portion such that one of the mattresses may be selectively deflated for rendering a stable surface along about half of a size of the base portion to allow a plurality of items to be positioned on the stable surface when the surface of the deflated air mattress is not needed for sleeping.

* * * * *